US010181638B2

(12) United States Patent
Tang et al.

(10) Patent No.: US 10,181,638 B2
(45) Date of Patent: Jan. 15, 2019

(54) RADIOFREQUENCY ANTENNA DEVICE

(71) Applicant: AUDEN TECHNO CORP., Taoyuan County (TW)

(72) Inventors: Chia-Lun Tang, Miaoli County (TW); Chi-Ming Chiang, Taoyuan County (TW); Chun-Chuan Chang, Keelung (TW); Tzu-Hsiang Chien, Taoyuan County (TW)

(73) Assignee: AUDEN TECHNO CORP., Taoyuan County (TW)

( * ) Notice: Subject to any disclaimer, the term of this patent is extended or adjusted under 35 U.S.C. 154(b) by 3 days.

(21) Appl. No.: 15/484,899

(22) Filed: Apr. 11, 2017

(65) Prior Publication Data

US 2018/0294549 A1 Oct. 11, 2018

(51) Int. Cl.
*H01Q 1/24* (2006.01)
*H01Q 1/48* (2006.01)
*H01Q 5/328* (2015.01)

(52) U.S. Cl.
CPC ..... *H01Q 1/245* (2013.01); *H01Q 1/48* (2013.01); *H01Q 5/328* (2015.01)

(58) Field of Classification Search
CPC ..... H01Q 1/245; H01Q 5/328
USPC ..... 343/702, 708, 700 MS
See application file for complete search history.

(56) References Cited

U.S. PATENT DOCUMENTS 8,996,080 B2 * 3/2015 You ..... H04B 1/3838 307/104
9,502,768 B2 * 11/2016 Huang ..... H01Q 1/002
9,774,079 B2 * 9/2017 Liu ..... H01Q 1/521
2017/0069954 A1 * 3/2017 Lui ..... H01Q 1/243

* cited by examiner

*Primary Examiner* — Peguy Jean Pierre
(74) *Attorney, Agent, or Firm* — Li & Cai Intellectual Property (USA) Office

(57) ABSTRACT

A radiofrequency antenna device includes a carrier, an antenna structure, a high-frequency blocking unit, and a proximity sensor (P-sensor), which are disposed on the carrier. The antenna structure includes a supporting frame disposed on the carrier, a first coupling segment disposed on the supporting frame, a second coupling segment disposed on the carrier, an insulating adhesive layer connected between the first and the second coupling segments, a radiating body disposed on the supporting frame and connected to the first coupling segment, and a feeding conductor disposed on the supporting frame. The feeding conductor is configured to transmit a signal to the radiating body. The high-frequency blocking unit is electrically connected to the first coupling segment. The P-sensor is electrically connected to the high-frequency blocking unit, and the P-sensor is electrically connected to the first coupling segment and the radiating body through the high-frequency blocking unit.

7 Claims, 7 Drawing Sheets

RADIOFREQUENCY ANTENNA DEVICE

BACKGROUND OF THE INVENTION

1. Field of the Invention

The present invention relates to an antenna device; in particular, to a radiofrequency (RF) antenna device.

2. Description of Related Art

For controlling a magnitude of radiation generated by a hand-held electronic device to a user, a proximity sensor (P-sensor) is added on an antenna structure for wireless wide area network (WWAN) thereof for detecting a distance between the user and the antenna structure, such that a protection mechanism can be activated by using the P-sensor to reduce the radiation of the antenna structure, thereby reducing the magnitude of radiation generated by the hand-held electronic device to the user.

Moreover, the conventional antenna structure needs to have a capacitance member arranged between a radiating body and a ground, such that the radiating body can be used as a capacitance electrode of the P-sensor by electrically connecting to the P-sensor through the capacitance member. In other words, in order for the radiating body to be the capacitance electrode of the P-sensor, the capacitance member disposed on the radiating body is a necessary component for the conventional antenna structure. However, having the capacitance member disposed on the radiating body may influence the RF radiating efficiency of the radiating body, increase the cost of the conventional antenna structure, and complicate the manufacturing process of the conventional antenna structure.

SUMMARY OF THE INVENTION

The present disclosure provides a radiofrequency antenna device for effectively improving the drawbacks associated with conventional antenna structures.

The present disclosure provides a radiofrequency antenna device including a carrier, an antenna structure, a high-frequency blocking unit, and a proximity sensor. The antenna structure includes a supporting frame, a grounding conductor, an insulating adhesive layer, a radiating body, and a feeding conductor. The supporting frame is disposed on the carrier. The grounding conductor includes a first coupling segment and a second coupling segment spaced apart from the first coupling segment. A part of the first coupling segment is disposed on the supporting frame, and the second coupling segment is disposed on the carrier for grounding. The insulating adhesive layer is sandwiched between the first coupling segment and the second coupling segment to adhere the first coupling segment to the second coupling segment. The insulating adhesive layer does not influence a coupling between the first coupling segment and the second coupling segment. The radiating body is disposed on the supporting frame and connected to the first coupling segment. The feeding conductor is disposed on the supporting frame and is configured to transmit a radiofrequency signal to the radiating body. The radiating body is configured to be a capacitance electrode for detecting an external object, and a capacitance value between the radiating body and the external object is variable according to a distance between the radiating body and the external object. The high-frequency blocking unit is disposed on the carrier and is electrically connected to the first coupling segment. The proximity sensor is disposed on the carrier and electrically connected to the high-frequency blocking unit. The proximity sensor is electrically connected to the first coupling segment through the high-frequency blocking segment.

The present disclosure also provides a radiofrequency antenna device including an antenna structure, a high-frequency blocking unit, and a proximity sensor. The antenna structure includes a grounding conductor, a radiating body, and a feeding conductor. The grounding conductor includes a first coupling segment and a second coupling segment spaced apart from the first coupling segment. The second coupling segment is configured for grounding. The radiating body is connected to the first coupling segment. The feeding conductor is configured to transmit a radiofrequency signal to the radiating body. The radiating body is configured to be in a capacitance electrode mode to detect an external object, and a capacitance value between the detecting segment and the external object is variable according to a distance between the radiating body and the external object. The high-frequency blocking unit is electrically connected to the first coupling segment. The proximity sensor is electrically connected to the high-frequency blocking unit. The proximity sensor is electrically connected to the first coupling segment through the high-frequency blocking segment.

In summary, the RF antenna device in the present disclosure is provided with the first coupling segment and the second coupling segment, which can couple with each other, so that the RF antenna device does not require any capacitance member, which may influence the RF radiating effect of the antenna structure. Thus, the RF radiating efficiency of the antenna structure can be improved, the cost of the RF antenna device can be reduced, and the manufacturing method of the RF antenna device can be simplified.

In order to further appreciate the characteristics and technical contents of the present invention, references are hereunder made to the detailed descriptions and appended drawings in connection with the present invention. However, the appended drawings are merely shown for exemplary purposes, and should not be construed as restricting the scope of the present invention.

DETAILED DESCRIPTION OF THE PREFERRED EMBODIMENTS

References are hereunder made to the detailed descriptions and appended drawings in connection with the present invention. However, the appended drawings are merely provided for exemplary purposes, and should not be construed as restricting the scope of the present invention.

Figure 1:
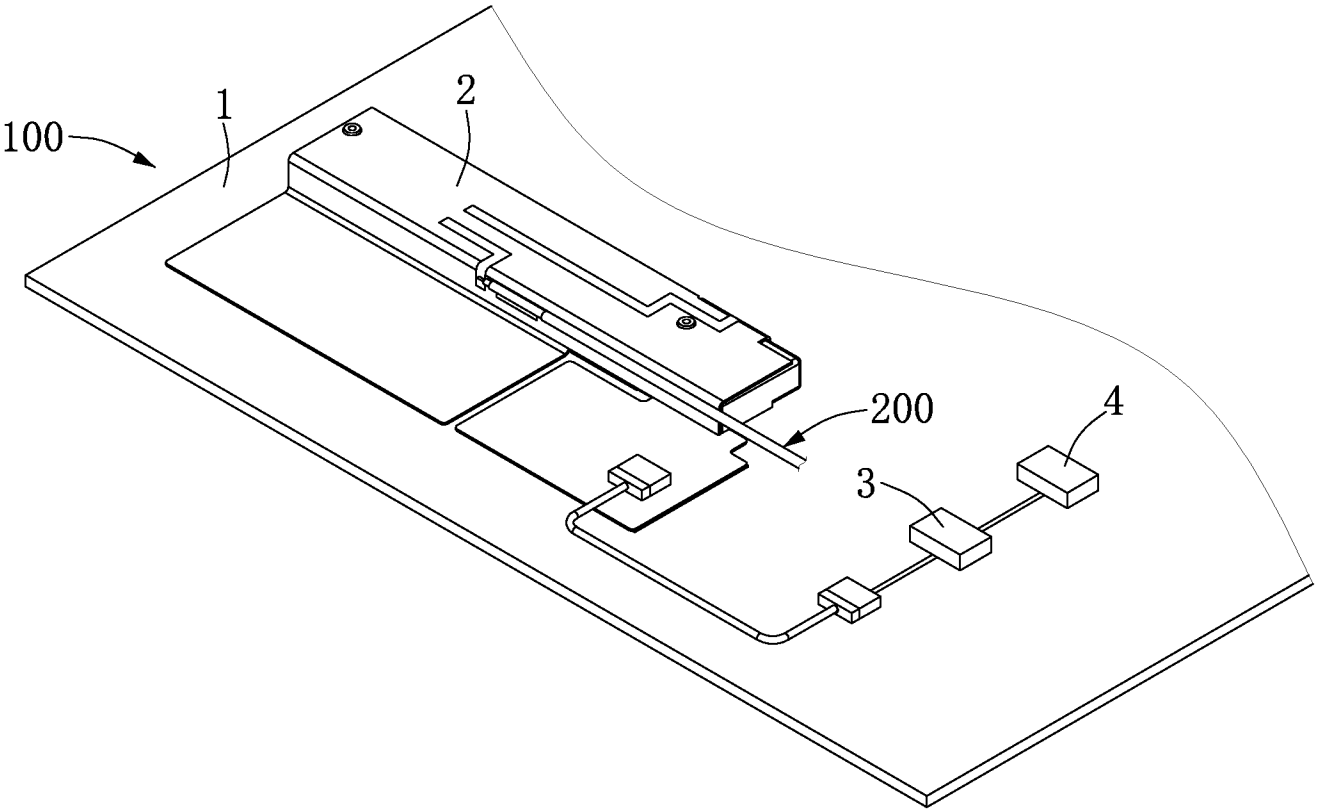
FIG. 1 is a perspective view showing a radiofrequency antenna device according to a first embodiment of the present disclosure.

Reference is made to FIGS. 1 to 6, which show an embodiment of the present disclosure. As shown in FIG. 1, the present embodiment provides a radiofrequency (RF) antenna device 100 for being installed in an electronic apparatus (not shown), and that cooperates with a signal feeding cable 200 of the electronic apparatus. The electronic apparatus can be a notebook computer, a tablet computer, a global positioning system (GPS) apparatus, a hand-held electronic device (e,g, a smart phone), or a wearable apparatus (e.g., a smart watch).

The RF antenna device 100 in the present embodiment includes a carrier 1, an antenna structure 2, a high-frequency blocking unit 3 disposed on the carrier 1, and a proximity sensor (P-sensor) 4 disposed on the carrier 1 and electrically connected to the antenna structure 2 through the high-frequency blocking unit 3. The carrier 1 can be, but is not limited to, an independent substrate, a circuit board, or a rear cover of an electronic apparatus.

Figure 2:
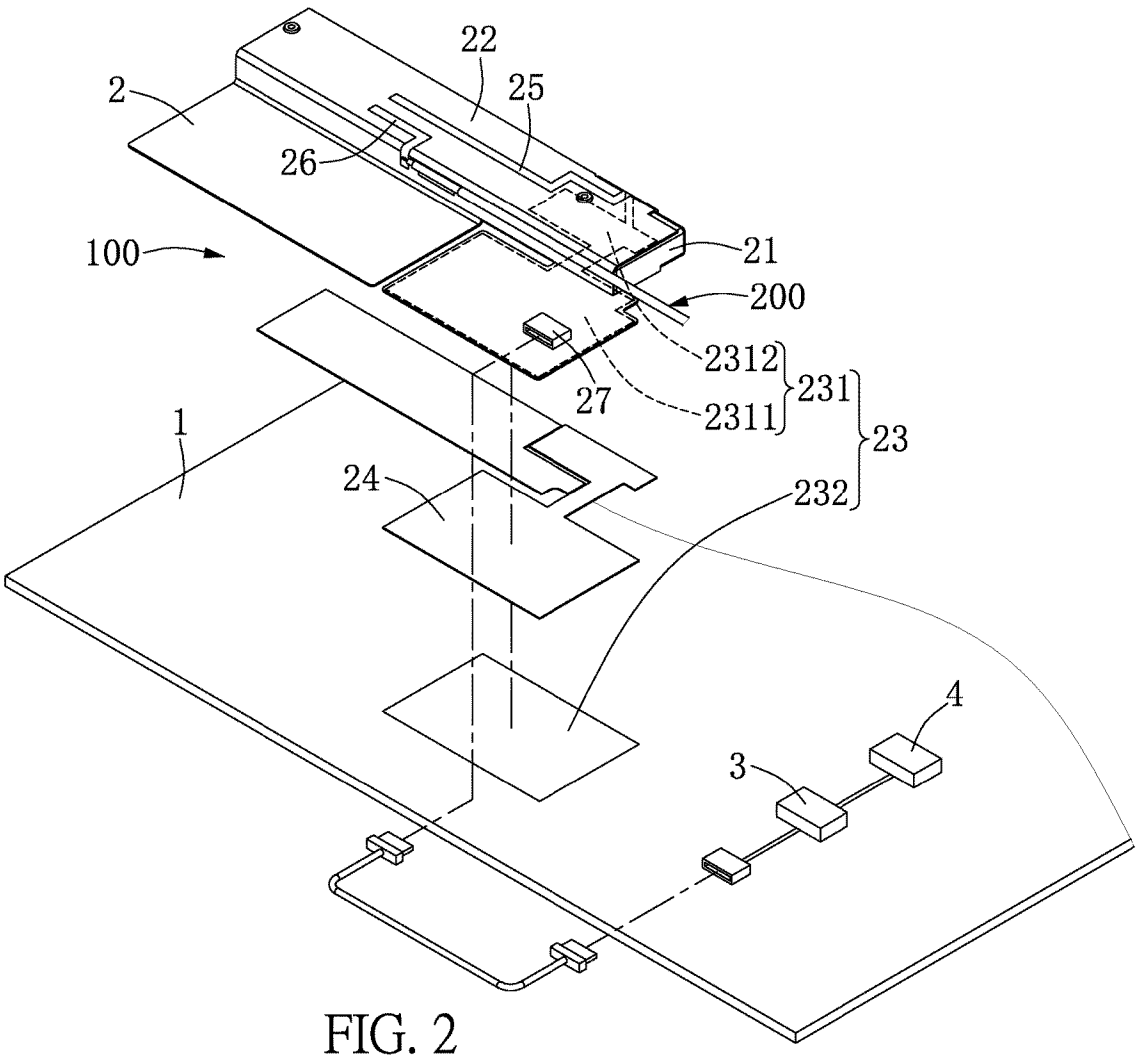
FIG. 2 is an exploded perspective view of FIG. 1.
Figure 3:
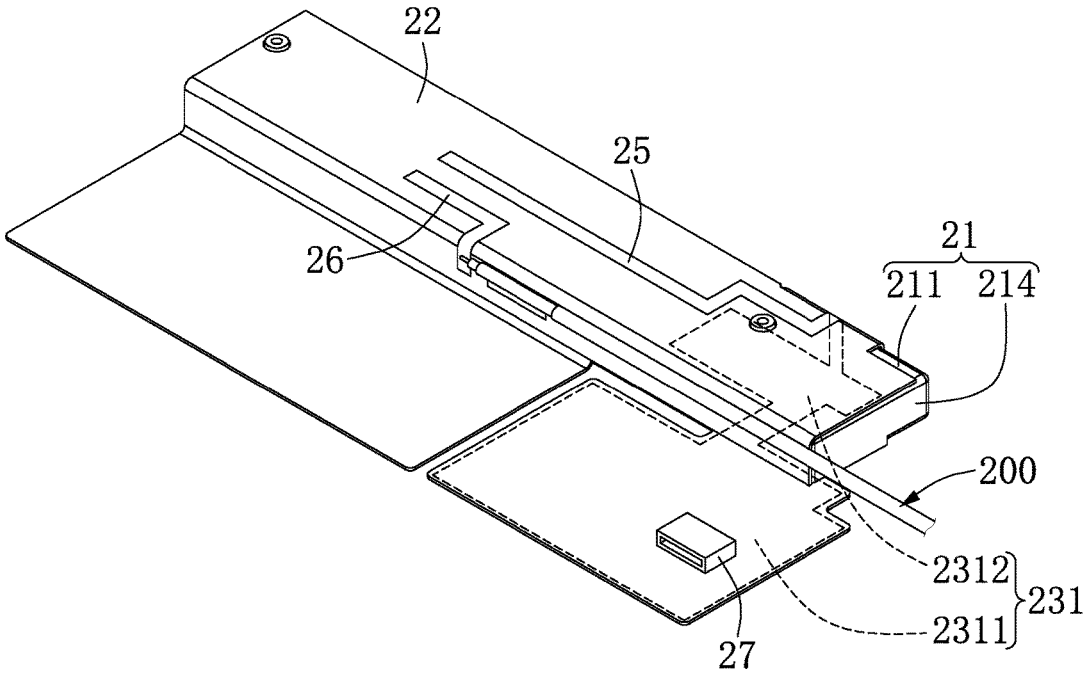
FIG. 3 is a perspective view showing part of the components of FIG. 1.
Figure 4:
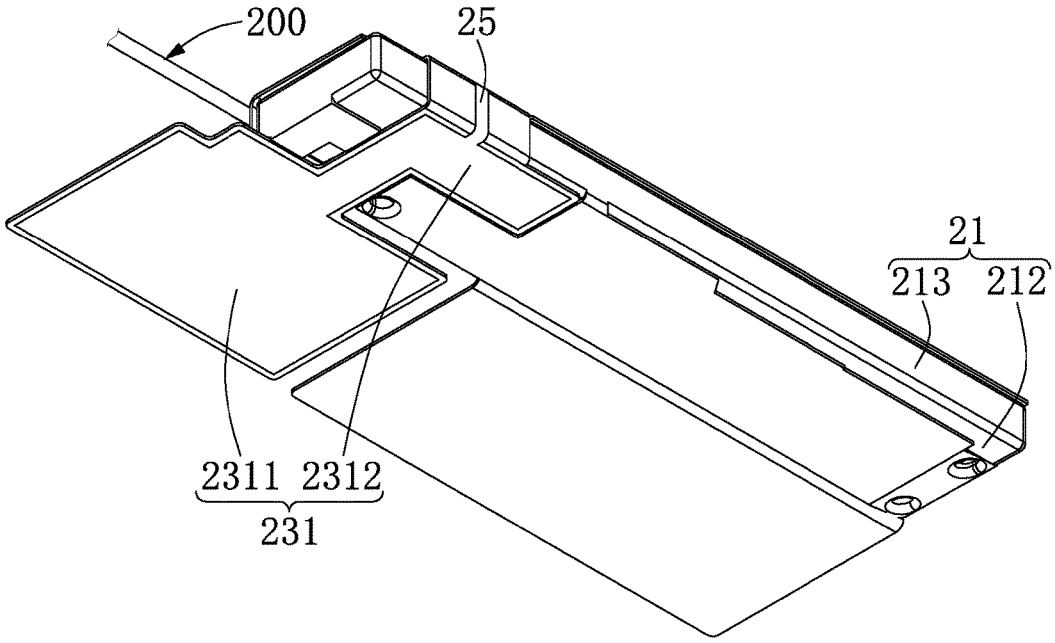
FIG. 4 is a perspective view showing part of the components of FIG. 1 from another perspective.
Figure 5:
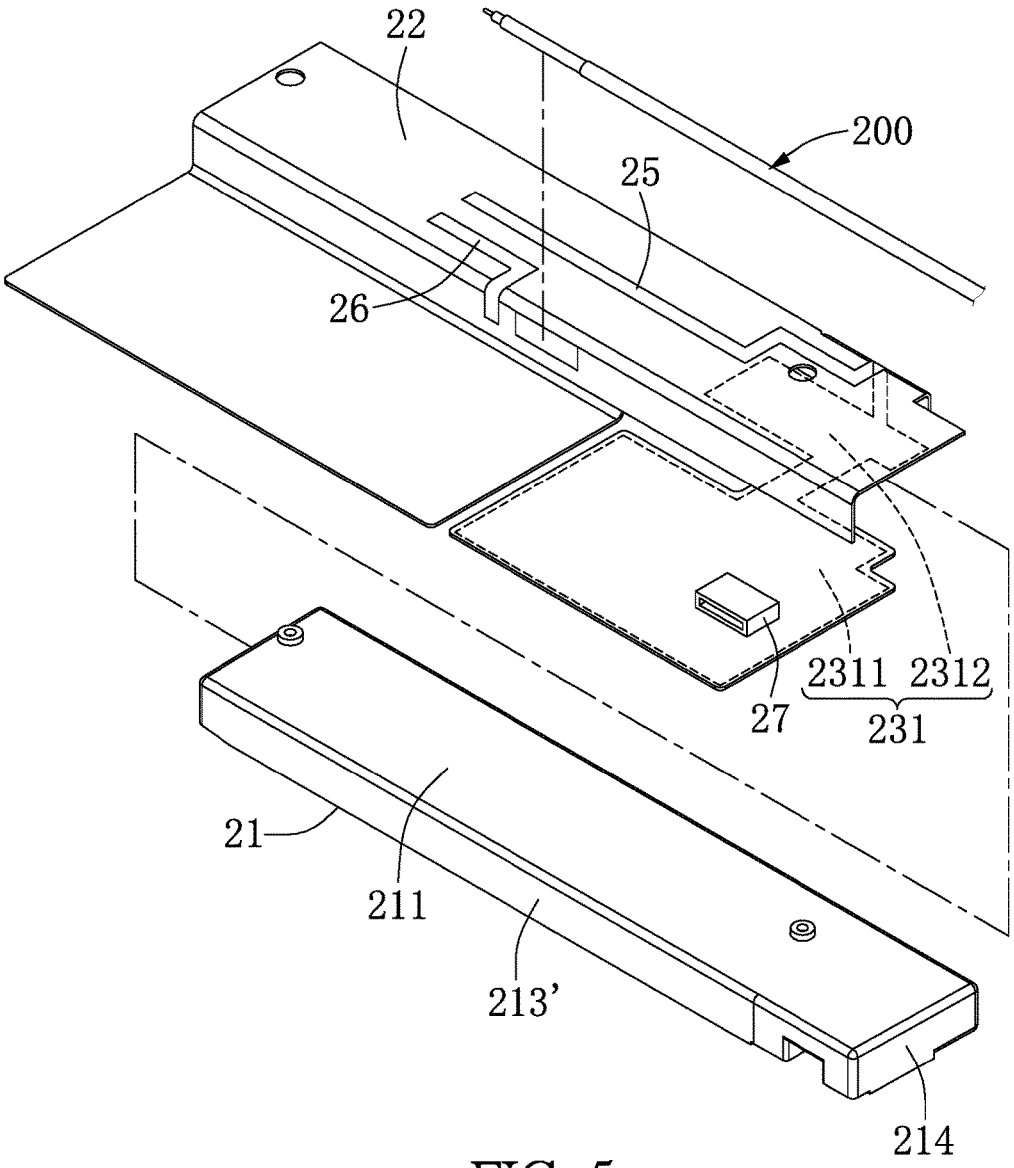
FIG. 5 is an exploded perspective view of FIG. 3.
Figure 6:
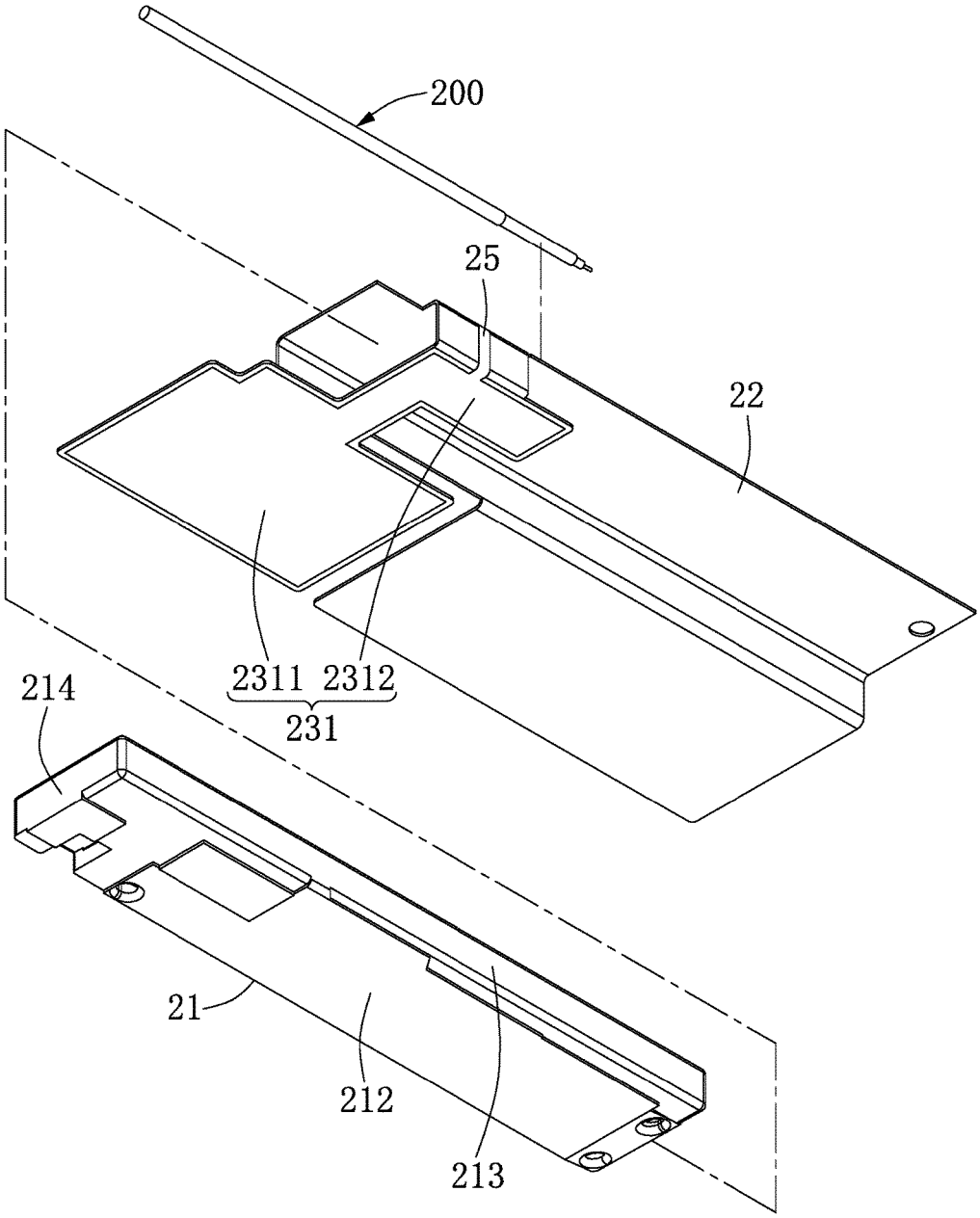
FIG. 6 is an exploded perspective view of FIG. 4.

As shown in FIGS. 2 to 4, the antenna structure 2 in the present embodiment is devoid of any capacitance member, but the present disclosure is not limited thereto. The antenna structure 2 includes a supporting frame 21, a flexible plate 22, a grounding conductor 23, an insulating adhesive layer 24, a radiating body 25, a feeding conductor 26, and an electrical connector 27. As shown in FIGS. 5 and 6, the supporting frame 21 in the present embodiment is a column having a substantially rectangular cross-section. The supporting frame 21 has a top surface 211, a bottom surface 212, two long side surfaces 213, 213', and two short side surfaces 214. The bottom surface 212 of the supporting frame 21 is disposed on the carrier 1. The flexible plate 22 is bent to cover at least four surfaces of the supporting frame 21 (i.e., the top surface 211, the bottom surface 212, and the two long side surfaces 213, 213').

As shown in FIGS. 2 to 4, the grounding conductor 23 includes a first coupling segment 231 and a second coupling segment 232 spaced apart from the first coupling segment 231. The first coupling segment 231 is formed on the flexible plate 22. A part of the first coupling segment 231 disposed on the bottom surface 212 of the supporting frame 21 is defined as a connecting portion 2312, and the other part of the first coupling segment 231 not disposed on the supporting frame 21 is defined as an adjusting portion 2311. The adjusting portion 2311 is configured to couple with the second coupling segment 232, and the size of the adjusting portion 2311 can be changed according to practical needs. It should be noted that in order for the adjusting portion 2311 to be carried by the supporting frame 21, an area of the adjusting portion 2311 is preferably smaller than or equal to ⅓ of an area of the supporting frame 21, but the present disclosure is not limited thereto.

Moreover, the second coupling segment 232 is disposed on the carrier 1 for grounding and is configured to couple with the first coupling segment 231. The first coupling segment 231 and the second coupling segment 232 in the present embodiment are arranged to face each other. The second coupling segment 232 is preferably arranged on a projecting area defined by orthogonally projecting the adjusting portion 2311 onto the carrier 1, but the present disclosure is not limited thereto.

Figure 7:
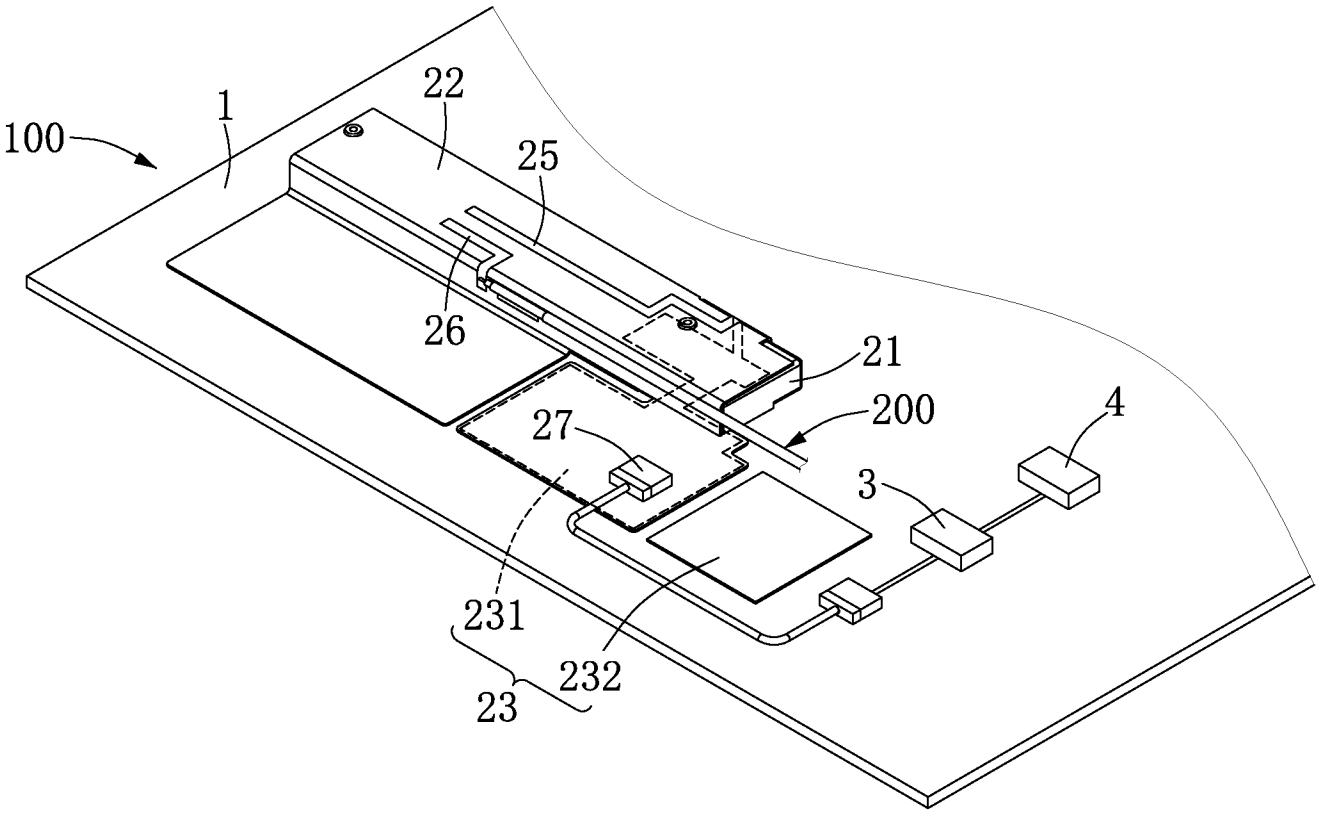
FIG. 7 is a perspective view showing a radiofrequency antenna device according to a second embodiment of the present disclosure.

For example, as shown in FIG. 7, the first coupling segment 231 can be coplanar with the second coupling segment 232, and the first coupling segment 231 and the second coupling segment 232 are spaced apart from each other and are configured to couple with each other. Furthermore, in other embodiments of the present disclosure, the second coupling segment 232 can be arranged on a projecting area defined by orthogonally projecting the first coupling segment 231 onto the carrier 1, so that the adjusting portion 2311 and the connecting portion 2312 can couple with the second coupling segment 232.

As shown in FIGS. 2 to 4, the insulating adhesive layer 24 is sandwiched between the first coupling segment 231 and the second coupling segment 232 to adhere the first coupling segment 231 to the second coupling segment 232. The insulating adhesive layer 24 does not affect a coupling between the first coupling segment 231 and the second coupling segment 232. Specifically, the adjusting portion 2311 in the present embodiment must be fixed in place, and the insulating adhesive layer 24 is configured to fix the adjusting portion 2311 and can be used as a dielectric material to separate the first coupling segment 231 and the second coupling segment 232. Thus, a fixing requirement of the adjusting portion 2311 and a coupling requirement of the first and second coupling segments 231, 232 can be achieved in the same step, thereby effectively simplifying the manufacturing method of the RF antenna device 100.

As shown in FIGS. 3 to 6, the radiating body 25 is formed on the flexible plate 22 and is disposed on the top surface 211 and the long side surface 213 of the supporting frame 21. The radiating body 25 is connected to a portion of the first coupling segment 231 disposed on the bottom surface 212 of the supporting frame 21. The adjusting portion 2311 of the first coupling segment 231 is arranged away from a portion of the radiating body 25 disposed on the long side surface 213. The shape of the radiating body 25 and a position of the radiating body 25 with respect to the supporting frame 21 can be changed according to practical needs, but are not limited to the present embodiment.

The feeding conductor 26 is formed on the flexible plate 22 and is disposed on the top surface 211 and the long side surface 213' of the supporting frame 21 (as shown in FIG. 5). The feeding conductor 26 is connected to the signal feeding cable 200 for receiving an RF signal from the signal feeding cable 200, and the feeding conductor 26 is configured to transmit the RF signal to the radiating body 25. Moreover, the feeding conductor 26 and the radiating body 25 in the present embodiment are spaced apart from each other and are configured to couple with each other through an RF signal, but the present disclosure is not limited thereto. For example, in other embodiments, the feeding conductor 26 can connect with the radiating body 25, and a capacitance member can be disposed on the feeding conductor 26.

As shown in FIG. 2, the electrical connector 27 is disposed on the adjusting portion 2311 of the first coupling segment 231. Specifically, the electrical connector 27 and the insulating adhesive layer 24 are respectively disposed on two opposite sides of the adjusting portion 2311 of the first coupling segment 231.

The high-frequency blocking unit 3 is disposed on the carrier 1 and is electrically connected to the first coupling segment 231. The high-frequency blocking unit 3 in the present embodiment can be a component or a structure having an inductance function (e.g., an inductance member and a corresponding wire or a microstrip). The high-frequency blocking unit 3 in the present embodiment is electrically and detachably connected to the first coupling segment 231 by using the electrical connector 27. Moreover, the P-sensor 4 is disposed on the carrier 1 and is electrically connected to the high-frequency blocking unit 3. The P-sensor 4 is electrically connected to the first coupling segment 231 through the high-frequency blocking segment 3, thereby further being electrically connected to the radiating body 25.

The structural features of the RF antenna device 100 of the present embodiment have been disclosed in the above description, and the following description discloses the operation of the RF antenna device 100. The radiating body 25 is configured to be a capacitance electrode (or in a capacitance electrode mode) for detecting an external object (e.g. a person). That is to say, the radiating body 25 can be used as a capacitance electrode of the P-sensor 4 for obtaining a capacitance value between the radiating body 25 and the external object. Specifically, the capacitance value is variable according to a distance between the radiating body 25 and the external object.

Moreover, when the radiating body 25 is in the capacitance electrode mode, the first coupling segment 231 and the second coupling segment 232 are in an open-circuit mode for preventing a detecting signal from flowing into the second coupling segment 232. When the feeding conductor 26 couples with the radiating body 25 through an RF signal and the RF signal flows into the radiating body 25, the high-frequency blocking unit 3 is in an open-circuit mode for preventing the RF signal from flowing into the P-sensor 4.

Specifically, when a detecting signal travels in the radiating body 25 of the antenna structure 2, the first coupling segment 231 and the second coupling segment 232 have a high impedance (such as an open-circuit) and the high-frequency blocking unit 3 has a low impedance (such as a short-circuit), so that the radiating body 25 can be used as a capacitance electrode of the P-sensor 4. When an RF signal transmitted from the feeding conductor 26 travels in the radiating body 25 of the antenna structure 2, the first coupling segment 231 and the second coupling segment 232 have a low impedance (such as a short-circuit) and the high-frequency blocking unit 3 has a high impedance (such as an open-circuit), so that the high-frequency blocking unit 3 can be used to effectively isolate the P-sensor 4 from the RF signal traveling in the radiating body 25, and the feeding conductor 26, the grounding conductor 23, and the radiating body 25 can be coupled through the RF signal so as to construct a mono-pole antenna.

Accordingly, when an external object is far from the antenna structure 2, an electronic apparatus (not shown) including the RF antenna device 100 of the present disclosure has an RF transmission function. When an external object is close to the antenna structure 2, a capacitance value between the radiating body 25 of the antenna structure 2 and the external object is increased, causing the P-sensor 4 to emit a corresponding signal to the electronic apparatus so as to reduce an intensity of a near field electromagnetic radiation. Thus, the radiation of RF signals (e.g., Specific Absorption Rate) generated by the electronic apparatus can satisfy a standard of each country if a user closely operates the electronic apparatus.

In addition, in other embodiments of the present disclosure, the RF antenna device 100 is devoid of at least one of the carrier 1, the supporting frame 21, the flexible plate 22, and the insulating adhesive layer 24, and the RF antenna device 100 can be used by cooperating with another component. Specifically, if the RF antenna device 100 is devoid of the insulating adhesive layer 24, the first coupling segment 231 and the second coupling segment 232 can be arranged on the same plane and be spaced apart by air from each other (as shown in FIG. 7).

In summary, the RF antenna device 100 in the present embodiment is provided with the insulating adhesive layer 24 to connect the first coupling segment 231 to the second coupling segment 232, and the first coupling segment 231 and the second coupling segment 232 can couple with each other, so that the RF antenna device 100 does not need to have any capacitance member, which may influence the RF radiating effect of the antenna structure 2. Thus, the RF radiating efficiency of the antenna structure 2 can be improved, the cost of the RF antenna device 100 can be reduced, and the manufacturing method of the RF antenna device 100 can be simplified.

Moreover, the first coupling segment 231, the radiating body 25, and the feeding conductor 26 are formed on the flexible plate 22, and the flexible plate 22 is bent to cover the supporting frame 21, so that the manufacturing method of the antenna structure 2 can also be can be simplified.

The descriptions illustrated supra set forth simply the preferred embodiments of the present invention; however, the characteristics of the present invention are by no means restricted thereto. All changes, alterations, or modifications conveniently considered by those skilled in the art are deemed to be encompassed within the scope of the present invention delineated by the following claims.

What is claimed is:

1. A radiofrequency antenna device, comprising:

a carrier;

an antenna structure including:

a supporting frame disposed on the carrier;

a grounding conductor including a first coupling segment and a second coupling segment spaced apart from the first coupling segment, wherein a part of the first coupling segment is disposed on the supporting frame, and the second coupling segment is disposed on the carrier for grounding;

an insulating adhesive layer sandwiched between the first coupling segment and the second coupling segment to adhere the first coupling segment to the second coupling segment, wherein the insulating adhesive layer does not affect a coupling between the first coupling segment and the second coupling segment;

a radiating body disposed on the supporting frame and connected to the first coupling segment; and a feeding conductor disposed on the supporting frame and configured to transmit a radiofrequency signal to the radiating body, wherein the radiating body is configured to be a capacitance electrode for detecting an external object, and a capacitance value between the radiating body and the external object is variable according to a distance between the radiating body and the external object;

a high-frequency blocking unit disposed on the carrier and electrically connected to the first coupling segment; and a proximity sensor disposed on the carrier and electrically connected to the high-frequency blocking unit, wherein the proximity sensor is electrically connected to the first coupling segment through the high-frequency blocking segment wherein a part of the first coupling segment not disposed on the supporting frame is defined as an adjusting portion, and an area of the adjusting portion is smaller than or equal to ⅓ of an area of the supporting frame.

2. The radiofrequency antenna device as claimed in claim 1, wherein the antenna structure includes a flexible plate covering at least four surfaces of the supporting frame, and the first coupling segment, the radiating body, and the feeding conductor are disposed on the flexible plate.

3. The radiofrequency antenna device as claimed in claim 1, wherein the antenna structure includes an electrical connector, the electrical connector and the insulating adhesive layer are respectively disposed on two opposite sides of the adjusting portion, and the high-frequency blocking unit is electrically and detachably connected to the first coupling segment by using the electrical connector.

4. The radiofrequency antenna device as claimed in claim 1, wherein the feeding conductor and the radiating body are spaced apart from each other and are configured to couple with each other through a radiofrequency signal.

5. The radiofrequency antenna device as claimed in claim 4, wherein the antenna structure is devoid of any capacitance member.

6. A radiofrequency antenna device, comprising:

an antenna structure including:

a grounding conductor including a first coupling segment and a second coupling segment spaced apart from the first coupling segment, wherein the second coupling segment is configured for grounding;

a radiating body connected to the first coupling segment; and a feeding conductor configured to transmit a radiofrequency signal to the radiating body, wherein the radiating body is configured to be in a capacitance electrode mode to detect an external object, and a capacitance value between the detecting segment and the external object is variable according to a distance between the radiating body and the external object;

a high-frequency blocking unit electrically connected to the first coupling segment; and a proximity sensor electrically connected to the high-frequency blocking unit, wherein the proximity sensor is electrically connected to the first coupling segment through the high-frequency blocking segment, wherein the antenna structure includes an insulating adhesive layer sandwiched between the first coupling segment and the second coupling segment to adhere the first coupling segment to the second coupling segment, and the insulating adhesive layer does not affect a coupling between the first coupling segment and the second coupling segment; and wherein the antenna structure includes an electrical connector, the electrical connector and the insulating adhesive layer are respectively disposed on two opposite sides of the first coupling segment, and the high-frequency blocking unit is electrically and detachably connected to the first coupling segment by using the electrical connector.

7. The radiofrequency antenna device as claimed in claim 6, wherein the feeding conductor and the radiating body are spaced apart from each other and are configured to couple with each other through a radiofrequency signal, and the antenna structure is devoid of any capacitance member.

* * * * *